United States Patent [19]

Boswinkel

[11] 3,945,651

[45] Mar. 23, 1976

[54] CHAIR WITH INDEPENDENTLY PIVOTABLE SEAT CUSHION AND BACK FRAME

[76] Inventor: Paul Boswinkel, Churchill-laan 183[1], Amsterdam, Netherlands

[22] Filed: May 31, 1974

[21] Appl. No.: 474,871

[52] U.S. Cl. ..... 297/337; 297/310; 297/354; 297/408

[51] Int. Cl.[2] ..... A47C 1/02; A47C 3/00

[58] Field of Search ..... 297/286, 301, 311, 312, 297/408, 383, 329, 310, 354, 325, 326, 327, 300, 306, 291, 450, 29, 292, 293, 258, 68, 270, 259

[56] References Cited

UNITED STATES PATENTS

| | | | |
|---|---|---|---|
| 17,008 | 7/1857 | Witherell | 297/326 |
| 168,482 | 10/1875 | Hale | 297/326 X |
| 336,387 | 2/1886 | Child | 297/384 X |
| 1,303,994 | 5/1919 | Ulmann | 297/325 X |
| 1,435,741 | 11/1922 | Sadler | 297/292 |
| 1,983,206 | 12/1934 | Witzel | 297/310 X |
| 2,017,433 | 10/1935 | Carrington | 248/393 X |
| 2,549,902 | 4/1951 | Hibbard et al. | 297/325 X |
| 3,092,417 | 6/1963 | Drabert | 297/300 X |
| 3,284,134 | 11/1966 | Malitte | 297/329 |
| 3,286,971 | 11/1966 | Walter et al. | 297/337 X |
| 3,343,871 | 9/1967 | Yates et al. | 297/DIG. 10 |
| 3,698,766 | 10/1972 | Borenstein | 297/450 X |
| 3,743,350 | 7/1973 | Allen | 297/64 X |

FOREIGN PATENTS OR APPLICATIONS

| | | | |
|---|---|---|---|
| 623,225 | 5/1949 | United Kingdom | 297/291 |

*Primary Examiner*—James T. McCall
*Attorney, Agent, or Firm*—Flynn & Frishauf

[57] ABSTRACT

A chair includes a lower seat cushion member which is independently pivotable about a pivot on the chair frame and a rear back cushion member which is independently pivotable about a pivot on the chair frame. The rear and lower seat cushion members are not interconnected and are independently pivotable with respect to each other. The cushion members are preferably biased toward a neutral rest position with a weak biasing force so that the occupant of the chair can easily cause the cushions to pivot so as to assume the proper support position for the occupant.

25 Claims, 8 Drawing Figures

CHAIR WITH INDEPENDENTLY PIVOTABLE SEAT CUSHION AND BACK FRAME

This invention relates to chairs, and more particularly to reclining chairs which provide improved support to the occupant, while also allowing substantially complete freedom of movement of the occupant in the chair.

It has been shown that even in his sleep, man generally moves quite a bit. Even when resting, one generally changes position frequently. The structure on which one is resting should be capable of providing proper support to the whole body in the various different positions and also during movements between positions. Various attempts have been made to provide chairs having such characteristics, but all have been generally inadequate or overly complicated in construction. For example, prior art chairs disclosed in U.S. Pat. Nos. 2,532,025 and 2,535,138, both issued to A. E. Johnson, are rather complicated in construction and the movements of various elements of the chair are restrained relative to each other and are not independently free. For example, the back and the seat of the chair are interconnected by a linkage, thereby undesirably restraining independent movement of these elements. Moreover, the armrest of these prior art chairs are interconnected with the other movable elements of the structure so as to be movable in dependence of the positions of the other elements. This also is undesirable since it restrains complete freedom of movement of the occupant and unduly complicates construction.

The main object of the present invention is to provide an improved chair which is simple in construction and which provides for substantially complete freedom of movement of the occupant within the chair to substantially any desired position, while also providing improved support for the body in each position and also during the transitions between positions.

A further object of the invention is to provide a chair having an easily adjustable headrest so as to provide still better support, adjustability and comfort for the occupant.

SUMMARY OF THE INVENTION

According to the present invention, a chair includes a lower seat cushion which is independently pivotable about a pivot member secured to the chair frame and a rear back cushion member which is independently pivotable about a pivot member on the chair frame. The rear and lower seat cushions are not interconnected and are independently pivotable. Resilient members are provided for biasing the cushions in a substantially neutral rest position, the biasing means being sufficiently weak to enable an occupant of the chair to easily cause the cushions to pivot so as to assume the proper position to provide support for the occupant.

Preferably, a headrest is provided above the back cushion and according to a further aspect of the invention, the headrest is eccentrically mounted so that rotation thereof changes its position relative to the back cushion. This provides a full range of adjustability of the headrest so as to improve the occupant's comfort.

DETAILED DESCRIPTION OF ILLUSTRATED EMBODIMENT

Figure 1:
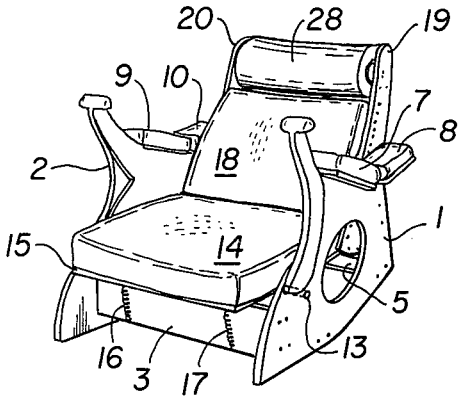
FIG. 1 is a perspective view of a chair according to the present invention.
Figure 3:
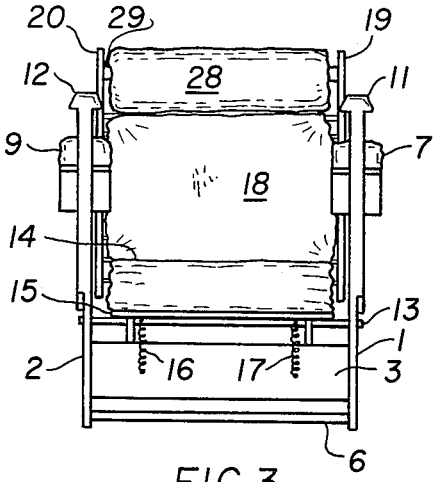
FIG. 3 is a front elevation of the chair of FIG. 1.

Referring to the Figures, the reclining chair according to the present invention includes two side frame members 1,2, a front cross member 3, rear cross members 4 and 5, and an intermediate cross member 6. The cross members 3,4,5 and 6 are secured to side members 1 and 2 so as to provide a rigid frame structure for the chair. Armrests 7 and 8 are secured to the upper part of side frame member 1 and armrests 9 and 10 are secured to side frame member 2. The armrests 7,8,9,10 may be fixed or movable. Members 11 and 12 extend upwardly from side members 1 and 2, respectively, and may be used as rests or as grips for aiding one in ascending out of the chair. Members 11 and 12 may be secured to extensions of side members 1 and 2, as shown, or may be separate bolted-on elements, as desired.

Figure 2:
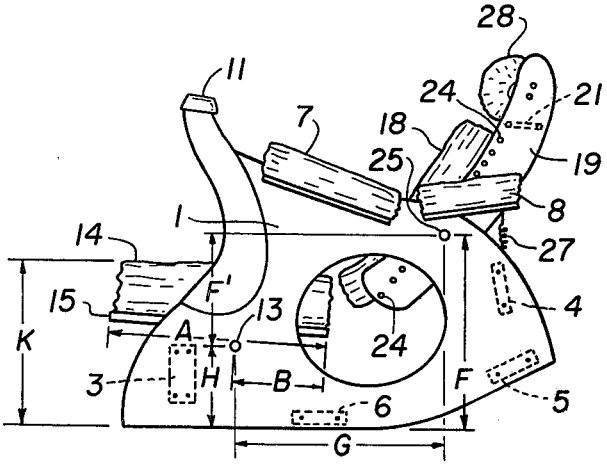
FIG. 2 is a side elevation of the chair of FIG. 1.
Figure 4:
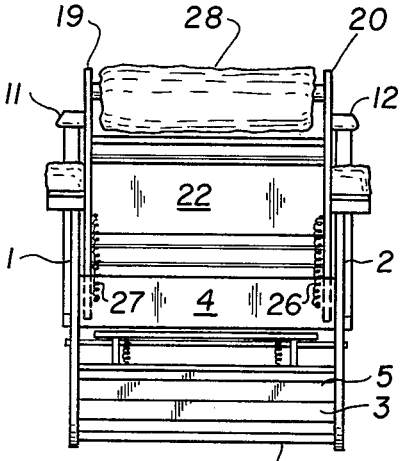
FIG. 4 is a partial rear view of the chair of FIG. 1.
Figure 5:
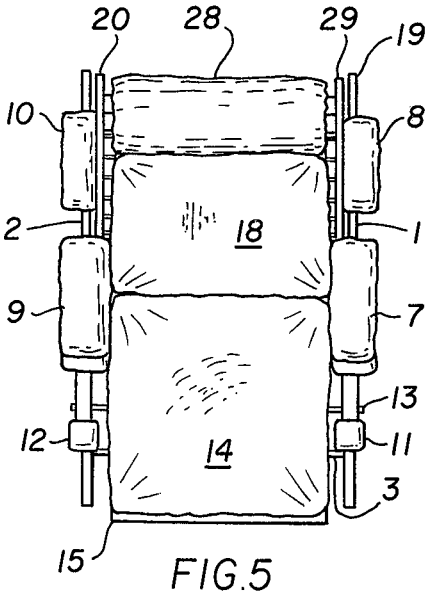
FIG. 5 is a top plan view of the chair of FIG. 1.

A pivot bar 13 extends between side members 1 and 2 and is supported by side members 1 and 2 for example by passing through bores in side members 1 and 2. In the illustrated embodiment, the pivot bar 13 extends through side members 1 and 2 and is secured in place by means of threaded nuts, or the like. It should be clear that the pivot bar 13 can be otherwise supported in side members 1 and 2. The lower cushion 14 rests on a flat support member 15 which in turn is mounted to bar 13 so as to be pivotable about bar 13. The forward end of the cushion support member 15 is connected to cross member 3 by means of coil springs 16 and 17, respectively. The springs 16 and 17 are preferably anchored at their ends by means of "eye" bolts or the like. When the lower cushion is rotated or pivoted about bar 13 in the clockwise direction as viewed in FIG. 2, the springs 16,17 are stretched and tend to return the lower cushion to its rest position as seen in FIG. 2. The cross member 3 also serves as a stop member for lower cushion 14 so as to limit counterclockwise rotation as viewed in FIG. 2. Bumpers of rubber may be located on either or both of cross member 3 and lower cushion support member 15 to cushion any impact therebetween and to prevent damaging the finish of the chair. The location of cross member 3 may be varied, and specifically it could be moved forward to allow springs 16 and 17 to be out of sight.

The rear or back cushion 18 is mounted in a frame comprising side elements 19 and 20. The back structure is shown in greater detail in FIGS. 6A and 6B. The side elements 19 and 20 are rigidly interconnected by means of cross members 21,22 and 23. Rods 24 extend between side members 19 and 20 so as to provide support for the rear cushion 18 which lies thereagainst, as seen more clearly in FIGS. 2, 6A and 6B. Rods 24 are preferably relatively stiff, but are able to bend a little. Rods 24 may be pre-shaped or contoured rods.

The back member is pivotally connected to the frame members 1 and 2 of the chair by means of a rod 25 which extends through the side members 19 and 20, the rod member 25 preferably also extending through the side members 1 and 2 of the chair and being secured in place for example by means of a threaded nut, or the like. Thus, the seat back portion of the chair is completely independently pivotable about bar 25 and relative to the main seat structure comprising side members 1 and 2. An appropriate clearance is provided between the back cushion and the lower seat cushion so that there is no interference therebetween when they are independently moved.

Coil springs 26 and 27 are provided so as to resiliently bias the seat back in a rest position, substantially as shown in FIG. 2. The springs are anchored at one end to the back members 19 and 20, and are anchored at the other end to cross member 4 of the chair. While the springs are shown anchored as above described, they can be anchored otherwise to other elements of the chair to provide the desired result. Also, while two springs are shown, one may be used. The cross member 4 of the chair also serves as a stop member for the back of the chair so as to prevent it from pivoting too far backward. The springs 26 and 27 have a relatively low biasing force so that the chair back is easily displaceable to different positions responsive to body movements of the occupants of the chair.

The headrest 28 is eccentrically and rotatably mounted to the side members 19 and 20 of the back portion of the chair. Merely by rotating the headrest 28 relative to its mounting shaft 29 the height of the headrest 28 relative to the cushion 18 and also the position of the headrest 28 relative to the plane of the cushion 18 is easily adjustable. By maintaining the proper frictional forces between the shaft 29 and the headrest 28, the headrest may be simply rotated by the occupant with only one finger and it will be retained in position by means of the frictional engagement. Alternatively, the shaft 29 of the headrest 28 may be rotatably journalled into the side members 19 and 20.

As another alternative, the headrest may be mounted so as to be freely and easily rotatable in only one direction — against the weight of the head of the occupant of the chair. Such a mechanism could include a ratchet-and-pawl device to allow free-wheel action. It should be clear that other headrest construction and mountings could be used. The headrests, however, should be as light as possible so as not to overstrain the springs 26 and 27.

In operation, when one sits on the rest cushion 14 of the chair, the feet may be placed near or far from the chair and the pivot action allows for free tilting of the seat. The pivot in the back of the chair enables one to sit straight or almost doubled up, or even stretched backward so far as to have the body in substantially a straight line. All of these various positions are achieved with substantially no effort and with no mechanism to be adjusted. The springs provide controlled movement, but do not overly restrain the movement of the chair elements.

In an advantageous form, the pivots and stop members for lower seat cushion member 15 are arranged so as to allow the lower cushion to pivot or roll in the forward direction about 4½ inches. This feature makes sitting down easier for those who generally have difficulties with the act of sitting down and getting up from low chairs.

When moving the various elements there are substantially no friction forces to overcome since the pivots are located so as to provide relatively easy motion and there are no mechanisms interconnecting the various elements of the chair, thus allowing free movement. By the location of the pivots for example as shown in the Figures, there results an automatic shortening and stretching of the room available for the back of the occupant, which shrinks or stretches as the occupant straightens out or bends in the chair. The horizontal seat and the back are pivoted so that the body can move from an upright to a leaning backward position without having to shift the body's position on either of the two cushions. This is extremely important in that the chair remains comfortable in all positions and movement from one body position to another is relatively effortless and does not require re-positioning of the body on the cushions. The cushions respond to natural body movement and adapt in position to the position of the body.

In the illustrated embodiment, the bottom edge of the side members 1 and 2 have a profile so as to enable a rocking motion to be imparted to the chair upon exertion of the proper physical forces by the occupant. The extract profile of the lower edge of members 1 and 2 may be varied at will. For example, the contours of the lower edges of members 1 and 2 may be adjustable by providing movable lower members which may be clamped in a final position to define the contour.

Figure 6A:
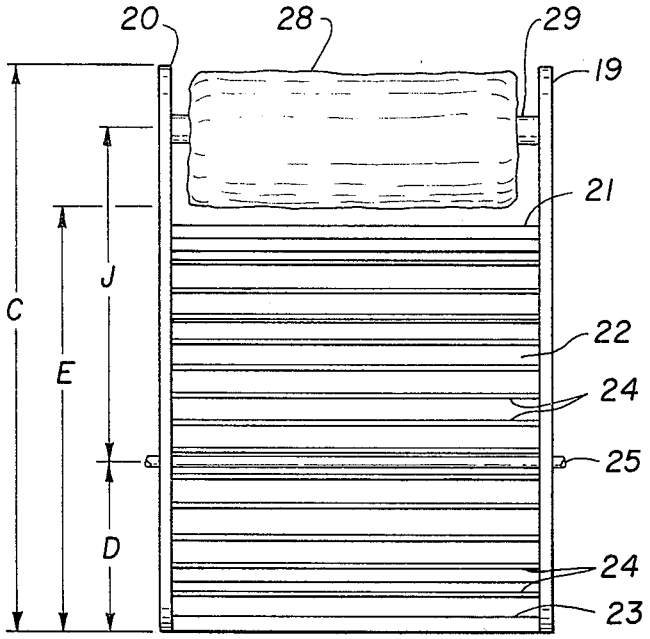
FIGS. 6A and 6B are detailed views of the seat back of the chair of FIG. 1.
Figure 6B:
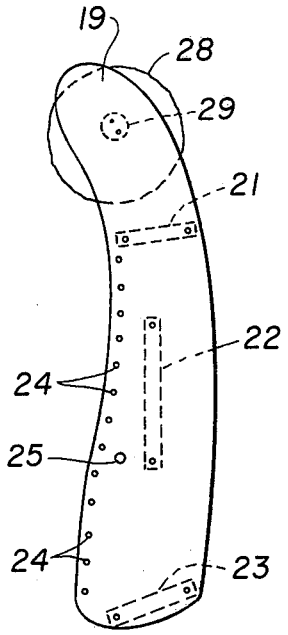

In a preferred embodiment of the chair illustrated in FIGS. 1–6B, the following approximate dimensional relationships have been found to be advantageous, the dimensions being labelled in FIGS. 2 and 6A:

| | APPROXIMATE DIMENSIONS (inches) |
|---|---|
| A | 17 |
| B | 7⅜ |
| C | 25⅞ |
| D | 7¼ to 7½ |
| E | 17⅝ |
| F | 15½ |
| F′ | 9 |
| G | 17 |
| H | 6½ |
| J | 15½ to 16 |
| K | 12 |

Thus, it is seen that in the illustrated embodiments the pivot bar 13 is located about 40%–45% of the distance along the lower seat cushion support member 15 as measured from the edge of the support member 15 which is interior of the chair, and the pivot 25 is located at about the mid-point of the rear cushion 18 or about 40% of the distance beginning at the lower edge of the members 19 and 20 and ending at the upper edge of the rear cushion 18. In a prototype, bar 13 was located about 9½ inches behind forward edge of member 15 and about 7½ from rear edge thereof. As seen in FIG. 6A, this means that the dimension D is approximately 40% of the dimension E. An important dimension is dimension F′, which insures that the pivot 25 is properly located relative to the back of the occupant of the chair. Likewise, the dimensions B and G are important. The cushions 14 and 18 may be any thickness, but preferably they are the same thickness so that the relative dimensions (i.e., F′ and G) are substantially the same for any type of cushion used. In a prototype, 3 inch thick cushions have been found to be advantageous. However, this thickness may vary depending upon cushion resilience, elasticity, etc.

Figure 7:
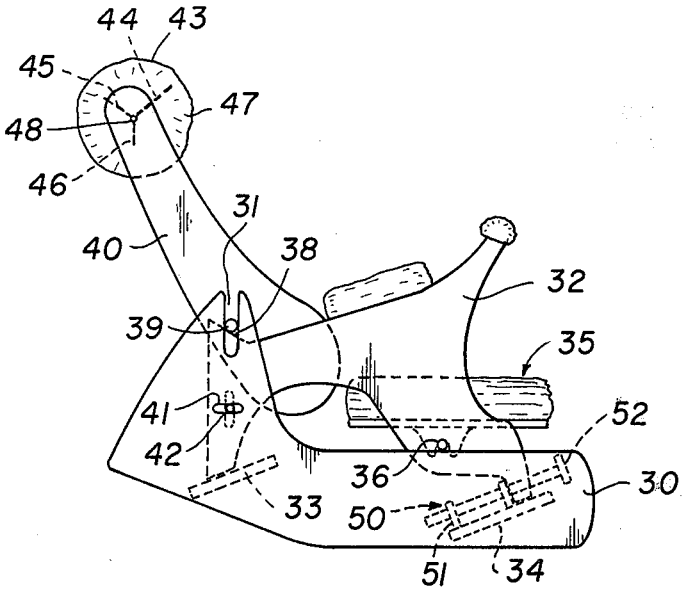
FIG. 7 is a modified adjustable version of a chair according to the present invention.

Referring to FIG. 7, there is shown another embodiment of the invention which is adjustable for different size occupants. A simplified side view of the embodiment of FIG. 7 is shown. It should be clear that various cross members are provided, similar to those shown in FIGS. 1-6A and that various cushion support members are provided as shown in the previously described embodiment. Only features which enable the embodiment of FIG. 7 to be adjustable are shown for ease of illustration. Also, since only one side view is shown, it is clear that mating parts are provided on the other "side" of the chair. The embodiment of FIG. 7 is also useful to take measurements for the construction of custom-made non-adjustable or less-adjustable chairs.

Referring to FIG. 7, side member 30 forms the base member of the chair and has a substantially vertically oriented slot 31 therein. Side member 32 is provided and is movable relative to the base member 30 on inclined ramp-type surfaces 33 and 34 which may form cross members of the side base members 30. Side member 32 also includes a pivotable seat portion 35, the pivot rod 36 of which is mounted to the side members 32. Various cross members (not shown) are provided as should be apparent.

Side members 32 also include an inclined surface 38 which moves relative to the side members 30 and on which the pivot bar 39 of the rear seat back rests. As the position of the side members 32 varies on the ramp members 33 and 34, the height of the pivot member 39 of the back 40 will vary accordingly. After adjustment of the side members 32 relative to the base members 30, the parts may be locked in place by means of screws, or the like. Elongated openings, such as opening 41 may be provided so that the parts may be secured together by means of, for example, bolts 42 after the desired relative orientation of the chair parts is achieved.

Adjustment of the relative positions of members 30 and 32 may be accomplished by a screw device 50 rotatably mounted to member 32 (for example, mounted to a cross-piece extending from member 32) and selectively threaded into a threaded block 51 mounted to member 30. By rotating screw 50, by means of a handle 52, the relative positions of members 30 and 32 are varied. This adjustment screw means can render the locking arrangement 41-42 unnecessary.

A rotatable headrest 43 is provided which includes three ribs 44-46 of different width covered by thick, resilient material 47. The position of headrest 43 can be varied by rotating it about its axle or pivot 48 so the head of the occupant can rest against any of the ribs or in the hollow between adjacent ribs. This renders the headrest highly adaptable to different users. The headrest of FIG. 7 can also be used in the embodiment of FIGS. 1–6B.

Again referring to FIG. 7, by moving the seat part of the chair, which comprises seat 35 and side members 32, forward and higher on ramps 33 and 34, the chair becomes more convenient for taller persons. Moving it lower and backwards adapts the chair for smaller persons. Since the axle 39 of the seat back rests on the inclined surface 38 of the side member 32, the seat back 40 will be moved up and down to a degree determined by the inclined surface as well as depending upon the movement of the seat part of the chair. Since the axle 39 is contained in a substantially vertical slot, it is restrained in the horizontal position and can only move substantially vertically. In order to provide still more adaptability, the most rearward armrest (not shown in FIG. 7) which corresponds to the armrest portions 8 and 9 (see FIG. 5), are attached to the axle 39 of the seat back so that they move vertically along with movement of the seat back. This further improves comfort for the occupant.

In the embodiment of FIG. 7, substantially the same pivot points are provided relative to the pivotable portions so as to provide high adaptability to the occupant.

While the invention has been described above in detail, it is clear that various modifications and alterations may be made thereto within the scope of the inventive concept as set forth in the appended claims. For example, the various pivot bars may be replaced by pivot members which extend from the pivotable portions of the chair into receptacles on the fixed portions of the chair. Alternatively, the pivot bars may extend from the fixed portions and engage the pivotable portions, and in either case, need not extend along the whole width of the chair. Also, different types of stop members could be provided, the location and number of cross members can be varied and the size and shape of the chair may be varied at will. The upholstery, materials and outward shape of the chair may also be varied within the scope of the invention.

I claim:

1. A chair adjustable by the occupants between seating and reclining positions responsive to forces generated by the body of an occupant, comprising:

a lower frame (1-6);

a seat cushion member (14,15) pivotally and non-lockably mounted to said lower frame and being substantially freely pivotable during occupation of the chair responsive to forces generated by an occupant of the chair;

first stop means (3) on said lower frame for defining a range of said substantially free pivotal movement of said seat cushion member;

a back frame (19-23) carrying a back cushion (18), said back frame being pivotally and non-lockably connected to said lower frame at a position on said lower frame which is spaced a substantial horizontal distance from the rearward edge of said seat cushion such that when said back frame is vertical and said seat cushion is horizontal a large gap exists therebetween, said back frame being pivotally connected at a lower portion thereof, below its center line, to said lower frame, and being substantially freely pivotable during occupation of the chair at least between first and second positions responsive to forces generated by an occupant of the chair, said first and second positions respectively corresponding to occupant-sitting and occupant-reclining positions, said back frame being independent of said seat cushion and being pivotally movable relative to said lower frame independently of said seat cushion; and second stop means (4) on said lower frame defining a range of said substantially free pivotal movement of said back frame;

the pivotal connections to said lower frame member being located within the projection of the forward and rear extremities of said lower frame on a horizontal and being spaced from each other by a distance sufficient to permit the cushions to assume an occupant reclining position.

2. A chair according to claim 1 wherein said lower frame comprises first and second side members (1,2) and wherein said seat cushion member is interposed between said side members and is pivotally connected thereto by means of a bar means (13) extending between said side members (1,2).

3. A chair according to claim 2 wherein said bar means (13) is located rearwardly of the center line of said seat cushion member, said center line extending transversely of said seat cushion member between said side members of said lower frame.

4. A chair according to claim 1 comprising biasing (16,17) means for biasing said seat cushion member towards a rest position.

5. A chair according to claim 1 wherein said first stop means (3) limits the pivotal motion of said seat cushion member in one direction.

6. A chair according to claim 5 comprising biasing means (16,17) for biasing said seat cushion member towards said first stop means.

7. A chair according to claim 1 wherein said lower frame comprises first and second side members (1,2) and wherein said back frame is interposed between said side members and is pivotally connected thereto by means of a bar means (25) extending between said side members (1,2).

8. A chair according to claim 7 wherein said bar means (25) for pivotally connected said back frame to said lower frame is located below the center line of said back frame, said center line of said back frame extending transversely of said back frame between said side members of said lower frame.

9. A chair according to claim 2 wherein said back frame is pivotally connected to said lower frame by means of a back bar means (25) extending between said side members (1,2).

10. A chair according to claim 9 wherein said bar means (13) is located rearwardly of the center line of said seat cushion member, said center line of said seat cushion member extending transversely of said seat cushion member between said side members of said lower frame; and wherein said back bar means extend below the transverse center line of said back frame.

11. A chair according to claim 1 comprising biasing means (27) for biasing said back frame in a direction so that the upper part of said back frame pivots away from the seat cushion member.

12. A chair according to claim 1 wherein said second stop means (4) limits the pivotal motion of said back frame to a position wherein said back frame is in a substantially horizontal position.

13. A chair according to claim 12 comprising biasing means (27) for biasing said back means towards said second stop means.

14. A chair according to claim 1 comprising a headrest (28) adjustably connected to the upper end of said back frame and above said back cushion.

15. A chair according to claim 14 wherein said headrest is rotatable about a pivot axis extending transversely of said back frame.

16. A chair according to claim 15 wherein said pivot axis of said headrest is eccentric relative to said headrest so that said headrest is adjustable in position by being rotated about said eccentric pivot axis.

17. A chair according to claim 1 wherein said seat cushion member is pivotally mounted to said lower frame at a point approximately 40% along the length of said seat cushion member beginning at the portion of said seat cushion member which is innermost of said chair; and wherein said back frame is pivotally connected to said lower frame at a portion approximately 40% of the length thereof beginning at the lowermost part thereof.

18. A chair according to claim 1 comprising armrest means on said lower frame both forward of said back frame and rearward of the forward most portion of said back frame.

19. A chair according to claim 1 wherein said lower frame comprises first and second portions (30,32) which are movable relative to each other, said first portion (30) comprising the base and said second portion (32) carrying at least said pivotally mounted seat cushion member (35), said first and second portions of said lower frame being adjustably movable relative to each other to vary the distances between the pivots for said seat cushion and back frame to accommodate occupants of different sizes.

20. A chair according to claim 19 wherein said lower frame includes substantially vertically oriented slot means (31), and wherein said back frame is pivotally and adjustably mounted in said slot means.

21. A chair according to claim 20 wherein said second portion (32) of said lower frame has an inclined surface (38) in registration with said slot means (31), and wherein said back frame includes pivot means (39) in said slot means (31) and bearing on said inclined surface (38) whereby when the relative positions of said first and second portions of said lower frame are adjusted, said inclined surface causes the height of said pivot means and of said back frame to be varied.

22. A chair according to claim 19 comprising inclined bearing surfaces on said base portion of said lower frame, said second portion (32) of said lower frame being adjustably movable on said inclined bearing surfaces.

23. A chair according to claim 1 comprising a first pivot means (13) for pivoting said seat cushion member to said lower frame and a second pivot means (25) for pivoting said back frame to said lower frame, the vertical distance (F') between said first and second pivot means being approximately 9 inches and the horizontal distance between said first and second pivot means being approximately 17 inches.

24. A chair according to claim 5 wherein said lower frame comprises a pair of substantially vertically oriented side members (1,2) which are spaced apart in the horizontal direction; pivot means (13) mounted to said side members and pivotally mounting said seat member thereto; a substantially horizontally oriented member (3) extending between said side members (1,2) and below said seat cushion member forward of said pivot means, said horizontally oriented member (3) serving to retain said side members together and simultaneously serving as said first stop means.

25. A chair according to claim 24 comprising second pivot means (25) pivotally mounting said back frame to said side members (1,2); and a second substantially horizontally oriented member (4) extending between said side members (1,2) and being located rearward of said second pivot means, said second substantially horizontally oriented member serving to retain said side members together and simultaneously serving as said second stop means.

* * * * *